United States Patent [19]

Schippers et al.

[11] Patent Number: 4,789,112

[45] Date of Patent: Dec. 6, 1988

[54] YARN WINDING METHOD AND RESULTING PACKAGE

[75] Inventors: Heinz Schippers; Siegmar Gerhartz, both of Remscheid, Fed. Rep. of Germany

[73] Assignee: Barmag AG, Remscheid, Fed. Rep. of Germany

[21] Appl. No.: 84,408

[22] Filed: Aug. 10, 1987

[30] Foreign Application Priority Data

Aug. 9, 1986 [DE] Fed. Rep. of Germany ..... 3627081
Aug. 9, 1986 [DE] Fed. Rep. of Germany ..... 3627082

[51] Int. Cl.[4] ..... B65H 55/04

[52] U.S. Cl. ..... 242/178; 242/18 R; 242/18.1; 242/43 R

[58] Field of Search ..... 242/178, 177, 176, 175, 242/174, 159, 18 R, 18.1, 43 R

[56] References Cited

U.S. PATENT DOCUMENTS

| | | | |
|---|---|---|---|
| 2,539,942 | 1/1951 | Beeftinik | 242/18 R |
| 3,315,904 | 4/1967 | Hardee | 242/43 R X |
| 3,564,958 | 2/1971 | Richter . | |
| 3,638,872 | 2/1972 | Jennings | 242/18.1 |
| 3,666,431 | 5/1972 | Oswald . | |
| 3,946,956 | 3/1976 | Marzoli . | |
| 4,049,211 | 9/1977 | Spescha . | |
| 4,296,889 | 10/1981 | Martens . | |
| 4,504,021 | 3/1985 | Schippers et al. | 242/18.1 |
| 4,504,024 | 3/1985 | Gerhartz | 242/18.1 |
| 4,505,436 | 3/1985 | Schippers et al. . | |
| 4,561,603 | 12/1985 | Schippers et al. . | |
| 4,667,889 | 5/1987 | Gerhartz | 242/18.1 |
| 4,676,441 | 6/1987 | Maag | 242/18.1 |
| 4,697,753 | 10/1987 | Schippers et al. | 242/18.1 |

FOREIGN PATENT DOCUMENTS

| | | |
|---|---|---|
| 890315 | 4/1982 | Belgium . |
| 0064579 | 11/1982 | European Pat. Off. . |
| 1911735 | 6/1970 | Fed. Rep. of Germany . |
| 2540148 | 3/1977 | Fed. Rep. of Germany . |
| 2633474 | 2/1978 | Fed. Rep. of Germany . |
| 3324947 | 10/1984 | Fed. Rep. of Germany . |
| 3632338 | 5/1987 | Fed. Rep. of Germany . |
| 2302951 | 10/1976 | France . |
| 861140 | 2/1961 | United Kingdom . |

*Primary Examiner*—Stanley N. Gilreath
*Attorney, Agent, or Firm*—Bell, Seltzer, Park & Gibson

[57] ABSTRACT

A yarn winding method and resulting yarn package are disclosed, and wherein the yarn is wound onto a supporting tubular core by a traversing yarn guide and in accordance with either a random wind or a stepped precision wind. In each case, the winding is begun with the traversing speed having a predetermined initial mean value, and the mean value is then increased from the initial mean value to a predetermined maximum mean value, and such that the maximum value is reached when a predetermined base layer having a thickness (SB) of no more than about 10% of the total yarn layer thickness (S) of the finished yarn package is produced. The predetermined maximum value may be maintained during the remainder of the winding operation, and in addition, the circumferential speed of the package may be reduced during the initial increasing of the mean value of the traversing speed, and such that the winding speed and tension of the yarn remain substantially constant.

23 Claims, 3 Drawing Sheets

YARN WINDING METHOD AND RESULTING PACKAGE

BACKGROUND OF THE INVENTION

The present invention relates to a yarn winding method, and the resulting package, and which is particularly adapted for use in winding freshly spun and/or drawn synthetic filament yarns to form cylindrical cross-wound packages having flat end faces.

Cross-wound packages of synthetic filament yarn, and which are produced at a constant traversing speed, or at least within predetermined limits of a constant traversing speed, often have bulges and beads both on their circumferential surface and their end faces. The bulges on the end faces, which are generally of arcuate configuration in cross section, not only adversely affect the appearance of the package, but they also affect its quality in that so-called castoffs or sloughs develop in the areas of the bulges. These castoffs are formed by yarn lengths which slip out of the body of the package and onto the end face and span the end face in the manner of a secant over one or several yarn layers. Such castoffs cause difficulty in unwinding the yarn, particularly where the yarn is intended to be withdrawn at high speeds from the package.

It is accordingly an object of the present invention to produce a yarn package with good unwinding properties, and which is free of castoffs.

It is also an object of the present invention to provide a yarn winding method which produces a stable package, and which has an essentially cylindrical shape and does not exhibit either contractions or bulges on its end faces.

It is a further object of the present invention to provide a yarn package wherein the yarn layers of the package are stable, in that the yarn lengths deposited in the reversal areas of the package do not tend to slip toward the center of the package during unwinding. Such slippage can result in the slipped yarns overlying the yarn windings located further outwardly, so as to clamp these outwardly lying yarns during the unwinding.

It is also an object of the present invention to provide a yarn winding method of the described type and wherein the tension forces which are operative on the yarn being wound, are not subjected to significant fluctuations.

SUMMARY OF THE PRESENT INVENTION

The above and other objects and advantages of the present invention are achieved in the embodiments illustrated herein, by the provision of a method of winding a textile yarn into a core supported package, and in which the yarn is wound about the core at a substantially constant rate and while the yarn is guided onto the core by a traversing yarn guide so as to produce a finished yarn package having a total yarn thickness (S). The method includes the steps of beginning the winding of the yarn onto the core with the traversing speed having a predetermined initial mean value, and then increasing the mean value of the traversing speed from the initial mean value to a predetermined maximum mean value, and such that the maximum value is reached when a predetermined base layer is produced adjacent the core and which has a thickness (SB) of no more than about 10% of the total yarn thickness (S) of the finished yarn package.

It is preferred that the maximum mean value of the traversing speed be maintained, in any event, over 80% of the total yarn thickness, and preferably during the entire winding cycle.

The above method is advantageous and possible inasmuch as no further changes in the yarn tension result from the variation of the traversing speed. In any event, the changes in the yarn tension should be maintained within limits, and as a result, an alternative method suggests that the traversing speed is again lowered after having reached its maximum value, by no more than about 20% of the maximum value. This decrease may occur immediately after the maximum value is reached, however, it is also possible to initially maintain the maximum value for a period of time and then decrease the traversing speed later.

In accordance with the present invention, a base layer of the package is deposited on the core and is wound at a traversing speed which increases steadily, starting from a lowest value to a highest value. The thickness of this base layer is a fraction, and at most 10%, of the total yarn thickness of the package. In the present application, the yarn thickness of the entire package is defined as the thickness of the package achieved with the intended final package diameter, and disregarded is the fact that under certain circumstances an incompletely wound package may be produced. Also, in the case of such incompletely wound packages, the thickness of the base layer is determined with respect to the overall intended final diameter of the package. The term "thickness" as used in the present application is the difference between the radius of the package and the radius of the core on which the package is wound.

The thickness of the base layer during which the package is wound at an increasing traversing speed, may range from about 10 to 30 mm, and preferably between 15 and 25 mm.

In order to ensure that the yarn tension is uniform, and to avoid undue fluctuations of the yarn tension, the traversing speed is varied when the base layer is wound so that the angle at which the yarn is deposited on the package changes from about 3° to 7°, and preferably from 4° to 6°. It has been found that this change is adequate to achieve the objects of the present invention.

The tendency of the yarn lengths to cast off can be reduced by selecting the initial traversing speed to be sufficiently low so that the angle at which the yarn is deposited on the core does not exceed 6°. On the other hand, the angle of deposit at the maximum traversing speed is no more than 10°, and preferably less than 9°. In so proceeding, the lower value of the traversing speed produces an angle between 2° to 6°, preferably between 3° and 5°, and the upper value of the traversing speed produces an angle between 6° and 10°, preferably between 7° and 9°. This avoids that the deposited yarn slips in the direction toward the center of the package.

With the present invention, a package can be produced which also differs from conventional packages in its appearance. More particularly, the base layer serves to support the remaining outer yarn portions of the packages, and thus tends to counteract the tendency of the end faces to bulge outwardly, with the result that such bulging is minimized to an extent sufficient to effectively avoid negative effects. As a result, the end faces are free of castoffs and essentially flat, i.e., they lie in a plane normal to the package axis.

The theoretical cone angle alpha of the base layer is preferably between 65° and 80°. This is achieved primarily in that, starting from the smallest angle of deposit, the traversing speed is gradually increased while the base layer is wound, until the largest angle of deposit is reached, with the difference between the smallest and largest angle of deposit amounting, as noted above, to at least 3°. The angle of deposit is defined by DIN 61800 (German Industrial Standards), and it is the angle between the yarn and a tangent to the package surface which lies in a plane perpendicular to the axis of the core.

The above however does not necessarily mean that the base layer of the package has a conical, i.e. inclined end face. Rather, the angle of cone of the base layer is purely theoretical, and it only means that as a result of the variation of the traversing speed, the traverse stroke length is also changed by a factor of 15–45% of the layer thickness. This factor is referred to below as the factor of slope B, which is the reciprocal value of the tangent of the theoretical angle of slope. Thus B=unilateral stroke reduction/layer thickness.

It has been found that the layer thickness at which the maximum traversing speed has to be reached, and likewise the factor of slope, are dependent on the diameter of the core on which the yarn is wound. When determining the necessary thickness of the base layer, and the necessary factor of slope, the yarn tension at which the yarn is wound should also be considered. In this regard, the thickness of the base layer and the factor of slope are determined by tests. The higher the winding tension, the lower is the layer thickness and the greater the factor of slope.

According to the prior art, negative effects on the build of the windings result from a variation of the traversing speed. These negative effects result since as the traversing speed is varied, there is a concommitent substantial change in the tension at which the yarn is wound on the package.

A further aspect of the present invention assures that the winding tension does not reach unacceptable values, and in particular, does not change in an unacceptable manner. Particularly considered is the fact that the yarn tension must remain within certain limiting values, and that is must remain substantially constant during the course of the winding operation. As a result, the present invention also contemplates that the circumferential speed of the package may be reduced during the winding of the base layer, and as a function of the increase of the traversing speed, so that the winding speed of the yarn, and as represented by the geometrical sum of the circumferential speed of the package and the traversing speed, remains substantially constant.

The various known methods for controlling the formation of ribbons are not described in the present application. In this regard, conventional known technology for controlling the formation of ribbons in a random winding operation may be employed with the present invention.

The present invention may involve random winding or random cross winding, which is defined as any type of winding in which the traversing frequency is not continuously varied along with the speed of the spindle during the course of the winding operation. This includes all cross winds which are not precision winds according to DIN 61801, i.e., which have no constant ratio between the traversing frequency and the r.p.m. of the spindle or package. Such random cross winds are utilized in particular when winding man-made filaments, which advance at high, constant speeds, and with the traversing frequency being constant. However, random winds also involve those types of winds in which the traversing speed is varied without a fixed ratio to the speed of the spindle.

Within the present application, periodic and/or temporary changes of the traversing frequency for the purpose of ribbon breaking are disregarded, note for example U.S. Pat. Nos. 4,504,021 and 4,296,889. However, it should be noted that when within the present application reference is made to traversing speed, the mean value of the traversing speed is intended.

Another type of winding which has the advantages of a random wind, and which avoids the formation of patterns or ribbons, is the stepped precision wind. When applying the present invention to the stepped precision wind process, the traversing speed is constantly reduced between a given upper limit and a given lower limit in a recurring sequence of steps, with the speed first proportionally decreasing with the spindle speed, and then being increased so as to reach a given, smaller winding ratio. The winding ratio is here defined as the ratio of the spindle speed to the double stroke rate, with the double stroke rate being the traversing frequency and indicating the number of reciprocal motions of the yarn across the package length during the course of a unit of time. In such a method, the upper and lower limits of the traversing speed will have their minimum value at the beginning of the winding cycle, and these limits will be increased steadily or in steps as a function of the diameter, and until the base layer according to the present invention is wound.

The upper limit of the traversing speed is preferably varied between $F \times \sin 5°$ and $F \times \sin 9°$, and the lower limit is varied between $F \times \sin 4°$ and $F \times \sin 8°$, with F being the yarn speed. The distance between the upper limit and the lower limit is selected so that during the initial steps of the stepped precision winding operation, only slight changes of the traversing speed result, which can be easily tolerated by the yarn.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
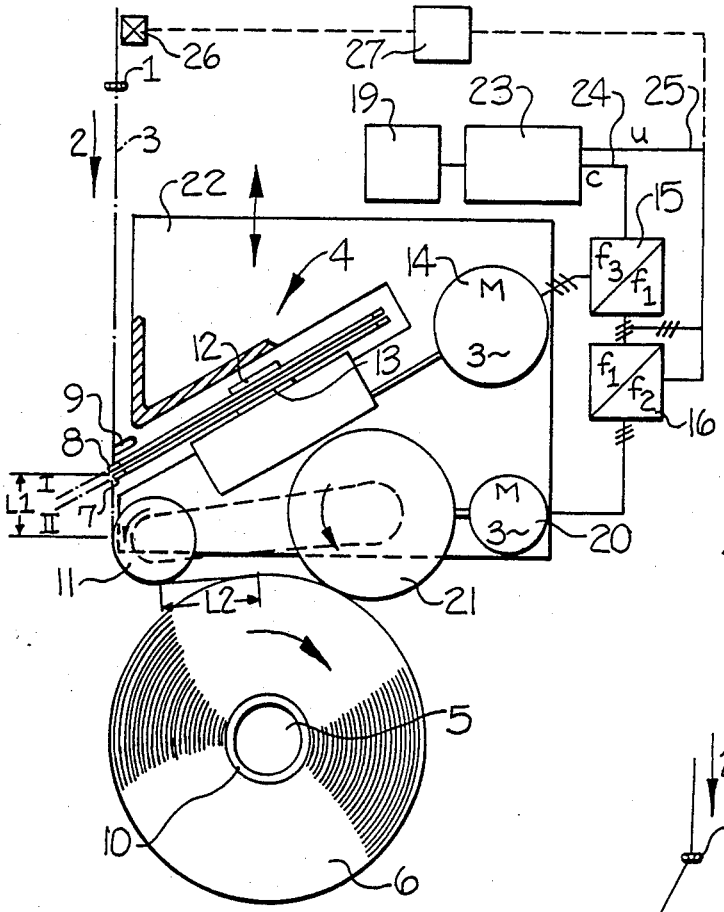
FIG. 1 is a cross sectional view of a yarn winding apparatus which embodies the features of the present invention.
Figure 2:
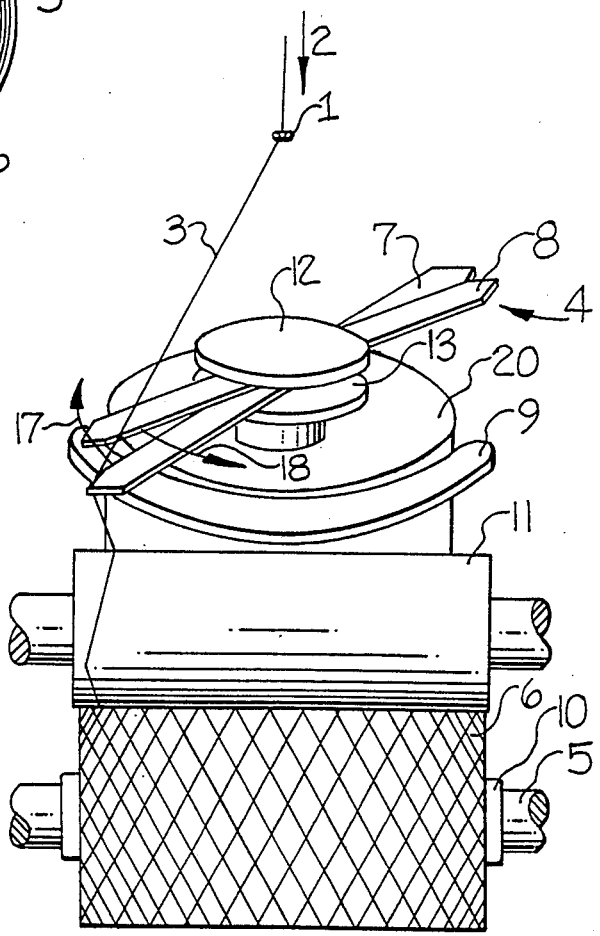
FIG. 2 is a side elevation view, partially schematic, of the winding apparatus shown in FIG. 1.
Figure 4:
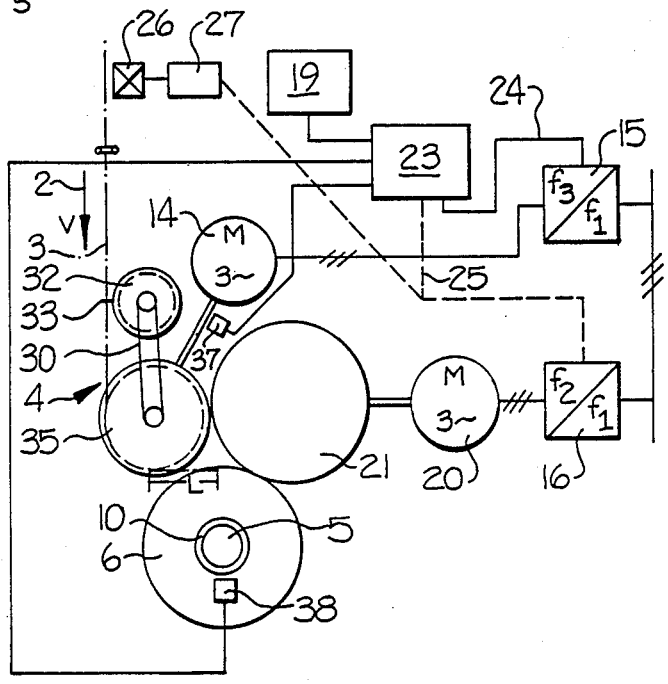
FIG. 4 is a cross sectional view of an embodiment of a yarn winding apparatus which embodies the present invention, and which is adapted for winding a cross-wound package in a stepped precision wind.

Referring more particularly to the drawings, FIGS. 1 and 2 illustrate a first embodiment of a yarn winding apparatus in accordance with the present invention, and FIG. 4 illustrates a second embodiment. In each embodiment, a yarn 3 continuously advances in direction 2, and is first guided through the stationary yarn guide 1 and then through the yarn traversing system 4. The winding spindle 5 is freely rotatable and coaxially mounts an empty tubular core 10. The yarn 3, which is composed for example of freshly spun and/or drawn synthetic filaments, advances at a constant speed, and is wound on the empty core 10 to form a package 6. To this end, a drive roll 21 contacts and drives the empty core at the beginning of the winding cycle, and it then contacts the surface of the subsequently formed package 6, so as to impart a constant circumferential speed. In addition, the yarn 3 is reciprocated along the package by the yarn traversing system 4, which is described below. The yarn traversing system 4 and the drive roll 21 are both supported on a slide 22, which can be moved upwardly and downwardly as indicated by the double arrow, so that the drive roll 21 can give way to the increasing diameter of package 6.

An asynchronous motor 14 drives the yarn traversing system. The drive roll 21 is driven by a synchronous motor 20 at a substantially constant circumferential speed, as further explained below. The three-phase motors 14 and 20 receive their power from a frequency inverter 15 and 16, respectively. The synchronous motor 20, which serves as the package drive, is connected to the frequency inverter 16, which supplies an adjustable frequency f2. The asynchronous motor 14 is operated by the frequency inverter 15, which is connected with a computer 23 via the output line 24. The output signal of the computer 23 is dependent on the input, and is controlled by a programming unit 19, which can be programmed so that the course of the traversing speed, i.e. the control frequency f3 is controlled during the winding cycle. If a ribbon breaking sequence is included, the mean value of the traversing speed and additionally the frequency, the amplitude, and the form of the periodic deviation from the given mean value, are also controlled.

Alternatively, in the place of a ribbon breaking sequence having a periodically variable traversing frequency, the winding ratios may be controlled, so as to successively run in a series of individual steps during the winding operation, and so as to not form ribbons and as further described below.

In addition, the desired course of the circumferential speed of the package may be programmed. This is based upon the fact that as the traversing speed increases, an increase of the tension occurs at which the yarn is wound on the package. This increasing yarn tension may adversely affect the yarn quality and/or the quality of the package. To avoid such a adverse effect, the present invention provides that the circumferential speed of the package may be adapted to the change of the traversing speed. This change of the circumferential speed of the package may additionally be entered into the programming unit 19 and be used via the output signal of the computer for the control of the frequency inverter 16, so that the speed of the drive roll 21 is reduced when the yarn tension increases.

Alternatively, the yarn tension may be measured by the tensiometer 26 and the output signal may be used for the control of the frequency inverter 16. The output signal of this yarn tensiometer 26 is supplied, via an inverter and amplifier 27, to the frequency inverter 16 in such a manner that the speed of the drive 21 is reduced, when the yarn tension increases as monitored by the yarn tensiometer 26.

The above description applies to the embodiments of both FIGS. 1–2, and FIG. 4. Referring now only to the embodiment of FIGS. 1–2, the yarn 3 advances from the traversing system 4 to form a trailing length L1 extending to the roll 11, and it then loops around the roll 11 and continues to advance with a trailing length L2 tangentially onto the package. The trailing lengths L1 and L2 effect the length H, to which the yarn is deposited on the core or package (not FIG. 8). In accordance with the present invention, the length H is shortened by the increase of the traversing speed which occurs when the basic layer is wound from HB to H.

The yarn traversing system 4 consists of rotary blades and a roll 11 following the blades in the path of the advancing yarn. The yarn traversing motion possesses its own drive which is described below. The rotary blade traversing system and roll 11 are operatively connected in a manner not shown. Alternatively, the roll 11 may be operatively connected with the drive roll 21. The special advantage of the illustrated yarn traversing system is that the angle at which the yarn is deposited on the package may be varied, within limits, since the traversing speed is adjustable irrespective of the winding speed. In particular, it is possible to have the traversing speed vary constantly about a mean value for the purpose of avoiding the formation of ribbons, or to switch the traversing speed between two closely adjacent values, when there is the risk of a ribbon, or to vary the same temporarily and proportionately to the package speed.

The rotary blade yarn traversing system comprises a rotor 12 and a rotor 13. The two rotors may be arranged concentric or eccentric to each other, and both rotors are driven in opposite direction by a drive and a gear arrangement which is positioned in a gear box 20. The rotor 12 supports two, three, or four rotary blades 8, which rotate in a plane I in the direction of the arrow 18. The rotor 13 includes the same number of rotary blades 7, which rotate in a closely adjacent plane II in the direction of arrow 17. The rotary blades guide the yarn 3 along a guide edge 9. More particularly, each rotary blade 8 transports the yarn to the right as seen in FIG. 2, and transfers it, at the end of the guide edge 9, to one of the rotary blades 7, which transports the yarn in opposite direction to the other end of the guide edge, where again one of the rotary blades 8 takes over its return. Further details of the traversing mechanism may be obtained from U.S. Pat. Nos. 4,505,436 and 4,561,603, which are incorporated by reference.

Figure 3:
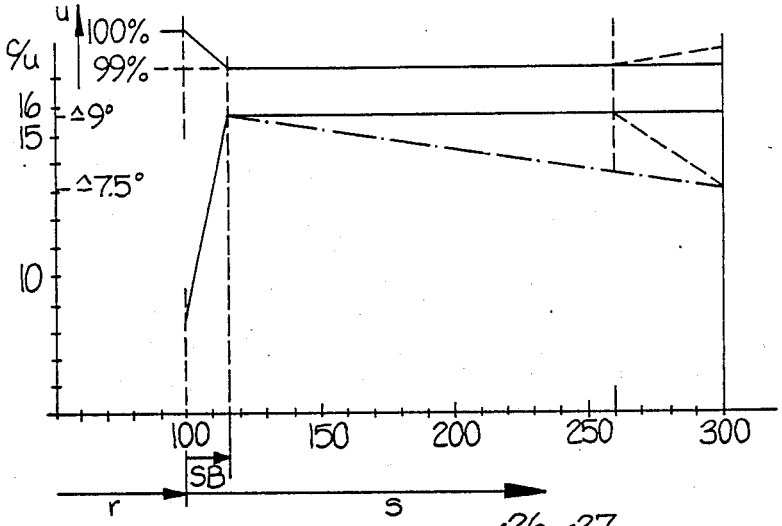
FIG. 3 is a diagram of the traversing speed in a random wind, and in accordance with the present invention.

FIG. 3 illustrates the programmed course of the mean value of the traversing speed during the winding cycle. The ordinate represents the ratio of the traversing speed to the constant circumferential speed of the package (C/U). The abscissa represents the radius of the package as it builds, or, respectively the yarn thickness S of the package, as it forms, for a package which is formed on a core with a diameter of 100 mm. The traversing speed increases steadily from a smallest value at the beginning of the winding cycle to the largest value.

As can be seen in FIG. 3, the maximum traversing speed is reached after the basic layer with a thickness SB has been wound. In so doing, the minimum traversing speed is chosen so that the yarn is deposited on the core at an angle of about 5°. The maximum traversing speed is chosen so that an angle of deposit which is at least three degrees greater, here 9°, is achieved. In the example, the traversing speed is increased steadily and linearly, as the layer thickness increases, from the minimum to the maximum value. The maximum traversing speed then remains constant, at least until 80% of the total yarn thickness of the package is built up, or until the end of the winding cycle as illustrated in the solid line in FIG. 3.

FIG. 3 further contains a diagram of the circumferential speed U of the package, with the circumferential speed being expressed as a percentage of the initial value of the circumferential speed. As can be noted from the diagram, the initial value of the circumferential speed is reduced by about 1% during the period of time in which the base layer is wound, so that unacceptable changes of the yarn tension are balanced and so that the winding speed remains constant in the ideal case.

As also illustrated in FIG. 3, the package has a final diameter of 300 mm, with the total yarn thickness being 200 mm and the base layer having a thickness of no more than 20 mm. The traverse speed remains constant when the maximum traverse speed is reached and until the end of the package as shown in the solid line. Alternatively, the traverse speed may decrease after 80% of the total thickness has been reached, i.e. from a diameter of 260 mm, and as indicated in the dashed line. The total decrease is preferably no more than 20% of the traverse speed, or in other words no more than a decrease of about 2° in the yarn deposit angle, resulting in a yarn deposit angle of about 7.5°. Simultaneously, with the decrease of the traverse speed, the circumferential speed of the package may be increased, in order to compensate for the loss of the yarn winding speed. This increase of the circumferential speed is also indicated by a dashed line.

The above described embodiment of decreasing the traversing speed helps to avoid slippage of the yarn windings. More particularly, the greater the angle of yarn deposit results in a greater tendency of the yarn windings to slip into a plane which is normal to the package axis, and this tendency also increases as the diameter of the package increases. In other words, the grip of each yarn winding on the surface of its layer is greater the smaller the diameter is, and therefore it is desirable to decrease the angle of yarn deposit, particularly with a yarn having low friction.

It is believed that the above slippage problem occurs primarily at the end of the package build. Thus as described above, the decrease of the traverse speed may occur after 80% of the total thickness has been reached. However, the decrease may alternatively occur steadily during the entire winding of the outer portion of the yarn package, as indicated in the dash-dot line in FIG. 3.

Referring now to the embodiment of FIG. 4, the yarn traversing system 4 includes a traversing yarn guide 33, which is caused to reciprocate transversely to the direction of the advance of the yarn by a cross-spiralled roll 32. In addition to the yarn guide 33, the yarn traversing system includes a grooved roll 35 which has an endless, reciprocating groove in which the yarn is guided with a partial looping. The distance between the line along which the yarn leaves the grooved roll 35, and the line along which the yarn advances onto the package 6, is defined as the trailing length L. Its magnitude determines the increase of the length H at which the yarn is deposited on the package, with a decrease of the traversing speed, not FIG. 8.

The computer 23 continuously receives the speed of the winding spindle 5, which is monitored by a measuring sensor 38. Also, it receives the output signal of the programming unit 19 which precedes the computer and is preferably freely programmable. In the case of a stepped precision winding process, the winding ratios are entered in the unit 19 which are to be run in each of the sequential steps of the winding process.

Advantageously, the actual traversing speed or the double stroke rate is also scanned by a measuring sensor 37, and the speed is entered into the computer, which performs a comparison between the desired and the actual value. The computer can then regulate the traversing speed of the yarn traversing system, which is driven by asynchronous motor 14, to the desired value, i.e., to the desired value which is proportionate to the spindle speed as dictated by the stored winding ratios. The main task of the computer is to carry out this determination of the desired value of the traversing speed. Details of this function are further described in U.S. Pat. No. 4,697,753.

The computer receives the precalculated ideal winding ratios from the programming unit 19. From these ideal winding ratios and the initial value of the traversing speed, the computer calculates "ideal" spindle speeds. The values of the "ideal" spindle speeds are compared with the actual spindle speeds which are determined by the measuring sensor 38. It the computer finds the spindle speeds identical, it will supply an output signal 24 to the frequency inverter 15 which represents the initial value of the traversing speed and which is likewise given as a desired value by the programming unit 19. As the winding cycle proceeds, the computer reduces this desired value proportionately to the constantly measured spindle speed, which decreases hyperbolically as the package diameter increases, and while the circumferential speed is constant. The present "ideal" winding ratio thus remains constant during this step of the precision wind. As soon as the computer now finds the actually measured spindle speed to be identical with the "ideal" spindle speed which is determined by the next winding ratio which is present as "ideal", it will again supply as output signal 24 the initial value of the traversing as the desired value. A new step of the precision winding process then follows.

Figure 5:
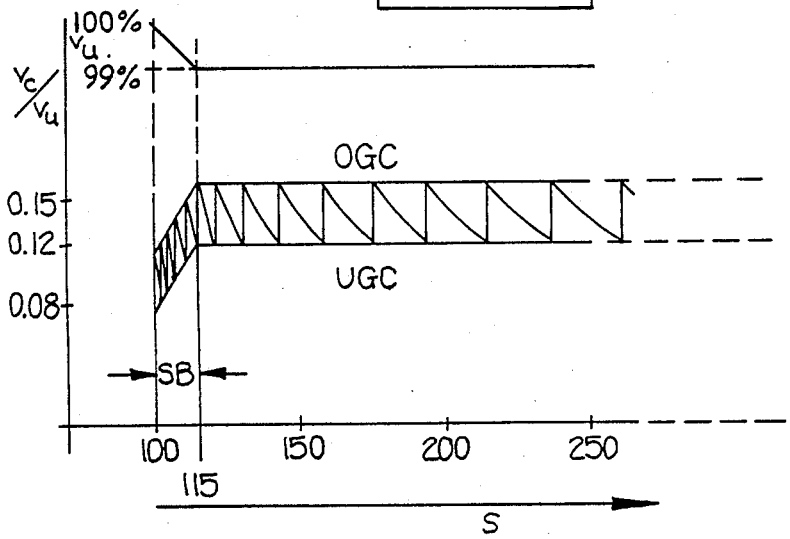
FIG. 5 is a diagram of the traversing speed in a stepped precision wind, and in accordance with the present invention.

It follows from the foregoing that in the described method, the traversing speed always remains between a given upper limit value and a given lower limit value. In accordance with the present invention, the law of traversing as shown in the diagram of FIG. 5 is additionally entered in the program. As illustrated, the abscissa in the diagram of FIG. 5 represents the yarn thickness S of the package proceeding from a core diameter of 100 mm. The ordinate is the ratio of the traversing speed to the circumferential speed of the package, with the circumferential speed of the package being substantially constant. Said otherwise, the ordinate represents the tangent of the angle of deposit, which also results from the aforesaid DIN (German Industrial Standards).

The upper limit OGC and the lower limit UGC of the traversing speed or, respectively, the quotient plotted on the ordinate, are set relatively low at the beginning of the winding cycle, i.e. at the 100 mm core diameter, so that an average angle of crossing of about 5° results. Then, within the relatively small base layer with the thickness SB, the upper and lower limits are both steadily increased to values which correspond to the average angle of deposit which is at least 3° greater. After the basic layer has been wound with a thickness SB, the upper limit OGC and the lower limit UGC of the traversing spped or, respectively, the quotient of traversing speed and circumferential speed, remain constant.

It should be mentioned that the upper and the lower limit values of the traversing speed extend essentially parallel to each other. A program is entered into the computer 23 of FIG. 4, which allows the traversing speed to be controlled during the winding cycle between the upper limit value and the lower limit value, as indicated in FIG. 5. In so doing the traversing speed first drops hyperbolically and proportionately to the spindle speed, and then suddenly increases again to the upper limit value. This method is maintained in a plurality of steps during the entire winding cycle.

As in the embodiment of FIGS. 1–2, the course of the circumferential speed of the package may be entered into the programming unit 19. The circumferential speed of the package may thus be adapted to the change of the limit values of the traversing speed.

FIG. 5 includes a diagram of the circumferential speed VU of the package, the circumferential speed being specified as a percentage of the initial value of the circumferential speed. As can be noted from the diagram, the initial value of the circumferential speed is reduced by about 1% while the base layer is wound, so that undue changes of the yarn tension are balanced and so that that winding speed ideally remains constant.

Figure 7:
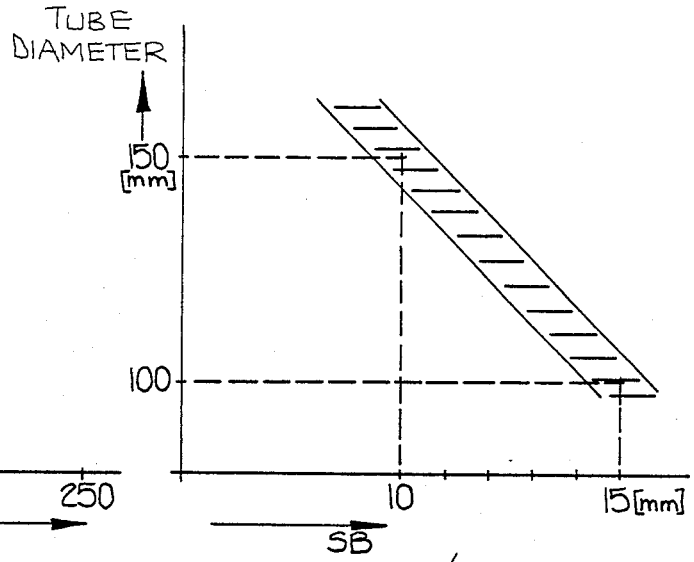
FIG. 7 is a diagram of the thickness of the basic layer in relation to the tube diameter.

According to the present invention, both the thickness SB of the base layer and the theoretical angle of slope alpha (FIG. 8) of the base layer are also dependent on the core diameter. FIG. 7 shows the interdependence of the core diameter and the thickness of the base layer to be produced. As the latter is wound, the traversing speed (FIGS. 1, 2, 3) or, respectively the upper limit and the lower limits (FIGS. 4, 5) are increased. The ordinate represents the core diameter, and the abscissa represents the thickness SB of the base layer. It results therefrom that the thickness of the base layer is inversely proportional to the core diameter, and it has been found that a good, stable package build, which is free of castoffs, can be obtained when the aforesaid interdependence is maintained.

As can be noted from diagram 7, in the case of a core having an outside diameter of 100 mm, the thickness SB of the base layer, at which the maximum mean value or, respectively, the maximum limit values of the traversing speed are to be reached, should range between about 14 to 16 mm. For standard core diameters this is based upon the following formula for the thickness of the base layer in dependence on the core radius: $SB=A(100-r)/100$, with r being the core radius, specified in millimeters, and A a value between 24 and 34. Included in the factor A is the tension at which the yarn is wound. In this connection, A needs to be determined by test. The higher the winding tension the lower is the factor A.

It has been possible to reduce the tendency to form castoffs by selecting the mean values or, respectively, limit values of the initial traversing speed to be sufficiently low so that the angle at which the yarn is deposited on the tube does not exceed 5°. On the other hand, the angle of deposit at the highest traversing speed should be no greater than 10°.

Figure 6:
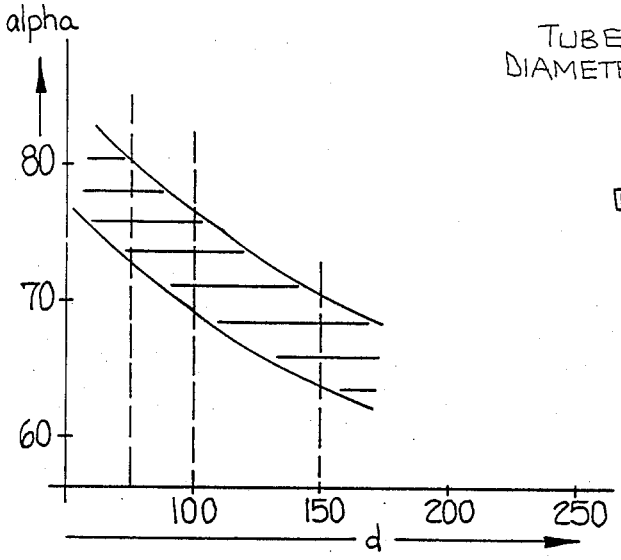
FIG. 6 is a diagram of the theoretical angle of slope with respect to the core diameter.

FIG. 6 illustrates the interdependence of the theoretical angle of slope alpha of the base layer, and the core diameter. In order to obtain a package with flat end faces, theoretically, a more steep front end face is to be wound with a smaller core. The theoretrical angle alpha is thus greater than when a base layer is wound on a core of larger diameter.

The difference to be selected between the maximum traversing speed and the minimum traversing speed or, respectively between the greatest and smallest angle of deposit serves to control the angle of slope. Here, the invention provides that the difference between the largest and the smallest angle of deposit should be at least 3° so as to obtain flat end faces.

Figure 8:
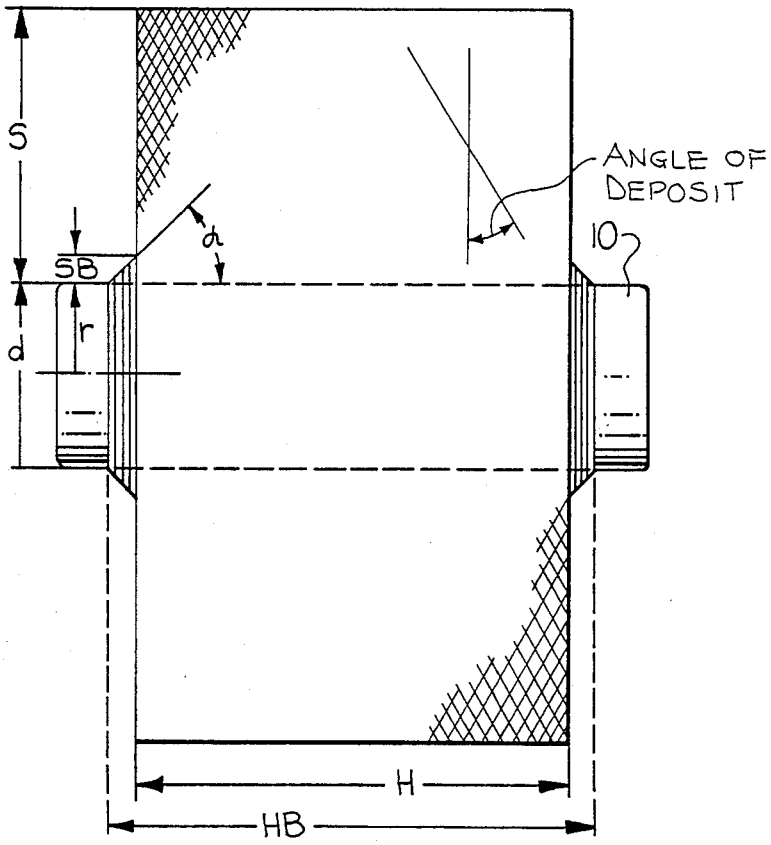
FIG. 8 is a somewhat schematic front view of a cross-wound package which is wound in accordance with the present invention.

FIG. 8 is a schematic view of a package 6 according to the present invention, which is formed on a core 10 with a radius r and a diameter d and a total yarn thickness S. The package is cylindrical and has essentially flat end faces which extend in planes which are normal to the axis of the core. In the area of the base layer with the thickness SB, the package has theoretically inclined end faces at a theoretical angle of slope alpha. It should be understood however, that the tendency of the end faces of the package to bulge causes these end faces of the base layer to change or lose their inclination. Also, the angle of slope alpha as illustrated in FIG. 8 is shown so as to clearly illustrate the principle of the invention, and it should be understood that the actual angle and shape of the package may differ from the illustration. The yarn windings crossing each other on the external surface of the package have an angle of deposit as indicated, which is the angle each yarn length has relative to a tangent placed on the package and which lies in a normal plane. As a practical result however, the base layer serves as a lateral support for the package, which avoids having the end faces of the package laterally bulge, and the formation of castoffs.

In the drawings and specification, a preferred embodiment of the invention has been illustrated and described, and although specific terms are employed, they are used in a generic and descriptive sense and not for purposes of limitation.

We claim:

1. In a method of winding a textile yarn onto a rotating core to produce a core supported package and wherein the yarn is wound about the core at a substantially constant rate and while the yarn is guided onto the core by a traversing yarn guide, and so as to produce a finished yarn package having a total yarn thickness (S), the improvement therein comprising the steps of beginning the winding of the yarn onto the core with a traversing speed having a predetermined initial mean value, and increasing the mean value of the traversing speed from said initial mean value to a predetermined maximum mean value, and such that said maximum value is reached when a predetermined base layer is produced adjacent said core and which has a thickness (SB) of no more than about 10% of the total yarn thickness (S) of the finished yarn package.

2. The method as defined in claim 1 comprising the further step of maintaining the traversing speed at said predetermined maximum mean value over at least about 80% of the total yarn thickness (S).

3. The method as defined in claim 2 comprising the further step of reducing the traversing speed from said predetermined maximum mean value by no more than about 20%, and after reaching about 80% of the total yarn thickness.

4. The method as defined in claim 1 comprising the further step of reducing the traversing speed from said predetermined maximum mean value continuously after reaching said base layer thickness (SB) and by no more than about 20%.

5. The method as defined in claim 1 wherein said base layer thickness (SB) is between about 10–30 mm.

6. The method as defined in claim 1 wherein said base layer thickness (SB) is determined from the formula $SB = A(100-r)/100$, wherein r is the radius of said core in millimeters, and A is a selected value between 24 and 34.

7. The method as defined in claim 1 wherein the step of increasing the mean value of the traversing speed results in a decreasing traverse length (H) of the yarn being deposited on the core, and wherein the ratio of the length reduction at each end of the package to the yarn layer thickness is between about 15–45%.

8. The method as defined in claim 1 wherein the step of winding the yarn onto a rotating core includes depositing the yarn on the core so as to define a yarn deposit angle which is the angle between the yarn and a tangent to the package surface which lies in a plane perpendicular to the axis of said core, and wherein the yarn deposit angle increases by about 3°–7° during the increase from said initial mean value to said maximum mean value of said traversing speed.

9. The method as defined in claim 8 wherein said beginning step includes winding the yarn onto the core so as to provide a yarn deposit angle of between about 2°–5° during said initial mean value of said traversing speed, and wherein said increasing step includes winding the yarn onto the core so as to provide a yarn deposit angle of between about 6°–10° during said maximum mean value.

10. The method as defined in claim 1 comprising the further step of reducing the circumferential speed of said rotating core and the resulting package during said step of increasing the mean value of the traversing speed, and such that the winding speed and tension of the yarn remains substantially constant.

11. The method as defined in claim 10 wherein the step of reducing the circumferential speed of said package includes controlling the circumferential speed by means of a stored program of a computer.

12. The method as defined in claim 1 wherein said step of increasing the mean value of the traversing speed includes uniformly increasing the traverse speed during said step, and said method includes the further subsequent step of maintaining the traversing speed substantially constant upon reaching said maximum mean value and during the remaining portion of the winding operation.

13. The method as defined in claim 1 comprising the further step of continuously varying the traversing speed between upper and lower limits during the step of increasing the mean value, and also during the remainder of the winding operation.

14. In a method of winding a textile yarn onto a rotating supporting core to produce a finished yarn package having a total yarn thickness (S), and which comprises the steps of winding the yarn about the rotating core at a substantially constant rate and such that the rotational speed of the resulting package gradually decreases, while guiding the yarn onto the core by a traversing yarn guide, decreasing the speed of the traversing yarn guide in proportion to the decreasing rotational speed of the package to define a substantially constant winding ratio during each of a series of sequential steps of the winding cycle, rapidly increasing the speed of the yarn traversing guide at the end of each sequential step to produce a stepped precision wind and so as to define upper and lower limits of the yarn traversing speed during each sequential step, the improvement therein comprising the steps of beginning the winding of the yarn onto the core with a traversing speed having a predetermined initial mean value, and increasing the mean value of the traversing speed from said initial mean value to a predetermined maximum mean value, and such that said maximum value is reached when a predetermined base layer is produced adjacent said core and which has a thickness (SB) of no more than about 10% of the total yarn thickness (S) of the finished yarn package.

15. The method as defined in claim 14 wherein the step of increasing the mean value of the traversing speed includes increasing the upper and lower limits of the yarn traversing speed so that they have approximately the same rate of change.

16. The method as defined in claim 15 wherein the upper limit of the traversing speed is varied between $F \times \sin 5°$ and $F \times \sin 9°$, and the lower limit is varied parallel thereto between $F \times \sin 4°$ and $F \times \sin 8°$, with F being the yarn speed.

17. The method as defined in claim 14 including the further step of reducing the circumferential speed of said package during said step of increasing the mean value of the traversing speed, and such that the winding speed and tension of the yarn remains substantially constant.

18. A yarn package comprising a supporting tubular core, a yarn wound upon said core in crossed helices and so as to form a package composed of a plurality of overlying yarn windings, with said windings defining a base layer disposed immediately adjacent said core and an outer portion positioned radially outwardly of said base layer, and said outer portion having a substantially constant length of yarn deposit, thereby defining substantially flat end face portions at each end of said core and wherein said base layer has a thickness (SB) which comprises no more than about 10% of the total yarn thickness (S) of said package, with the yarn deposit angle on said core being between 2° to 5° and increasing proportional to the thickness of the base layer by 3° to 7° and with the length of yarn deposit on the core being greater at both ends by about 0.5 to 2 mm than the length of yarn deposit in the outer portion of the package.

19. The yarn package as defined in claim 18 wherein said base layer at each end of said core has a slope factor of between about 15–45%, with the slope factor being defined as the ratio of the axial length of said inclined end face portion to the thickness of the base layer.

20. The yarn package as defined in claim 19 wherein said base layer has a thickness of between about 10–30 mm, and said core has a diameter of between 100–150 mm.

21. The yarn package as defined in claim 18 wherein said outer portion has a yarn deposit angle which is between about 6° and 10°.

22. The yarn package as defined in claim 21 wherein said yarn deposit angle in said outer portion is substantially constant.

23. The yarn package as defined in claim 21 wherein said yarn deposit angle in said outer portion decreases by no more than about 2°.

* * * * *